United States Patent [19]

Beall et al.

[11] 4,220,252

[45] Sep. 2, 1980

[54] BIOLOGICAL SPECIMEN PROCESS APPARATUS

[75] Inventors: Glenn L. Beall, Gurnee; Robert P. Noonan, Naperville, both of Ill.

[73] Assignee: Miles Laboratories, Inc., Elkhart, Ind.

[21] Appl. No.: 70,265

[22] Filed: Aug. 27, 1979

[51] Int. Cl.[3] ..... B65D 39/00

[52] U.S. Cl. ..... 220/307; 220/266

[58] Field of Search ..... 220/81, 306, 307, 266, 220/270; 425/17

[56] References Cited

U.S. PATENT DOCUMENTS

| | | | |
|---|---|---|---|
| Re. 28,165 | 7/1977 | McCormick | 425/17 |
| 3,390,806 | 12/1966 | Herbert | 220/307 |
| 4,022,352 | 5/1977 | Pehr | 220/306 X |
| 4,034,884 | 7/1977 | White | 220/306 X |

*Primary Examiner*—George T. Hall

*Attorney, Agent, or Firm*—Louis E. Davidson

[57] ABSTRACT

Container apparatus for processing biological specimens therein is described wherein a perforated receptacle member with abutment means is attached through a frangible hinge portion to a perforated cover member with detent means. When the cover member is rotated about the hinge to mate against the receptacle member, the detent means become interengageable with the abutment means to hold the cover and receptacle members in removable mating relationship.

8 Claims, 3 Drawing Figures

BIOLOGICAL SPECIMEN PROCESS APPARATUS

BACKGROUND AND PRIOR ART

It is well known in the art that biological tissues can be sliced into thin sections on a microtome for subsequent microscopic examination by a pathologist, for example. In order to prepare the specimen for such slicing it must first be processed with several fluids to dehydrate the tissue, to clear the tissue with a suitable oil and then to infiltrate the tissue with a paraffin wax or a combination of wax and resinous material. This processing has been conveniently carried out by placing the specimen in a fluid-permeable capsule and successively submerging the capsule in the necessary fluids. The resulting processed specimen is then removed from the capsule and embedded in a block of paraffin wax for subsequent mounting in a microtome for slicing.

Generally the capsule apparatus employed for the tissue processing is separate from the apparatus employed for embedding the specimen in paraffin. U.S. Pat. No. 3,674,396 (now U.S. Pat. No. Re. 28,165) describes improved apparatus wherein an open-topped box-like perforated mold member having a perforated removable cover can be used with the cover in place as a tissue processing capsule and with the cover removed can be used for embedding a specimen in paraffin. The apparatus described in the above prior art patent had the disadvantage that the removable cover was preferably formed from metal which required a separate production from the organoplastic base member. The cover also required separate handling from the base member. U.S. Pat. No. 4,034,884 describes a further processing apparatus employing a base member of the type described in the above U.S. Pat. No. Re. 28,165 but with a separate telescoping cover member. Here again the cover is separate from the base requiring separate manufacture and handling. Design Application Ser. No. 109, filed on Jan. 2, 1979 describes a processing apparatus having a cover member attached to a base member by a hinge portion. It was intended that the hinge portion be frangible such that the cover member could be easily separated from the base member once the biological specimen processing steps were finished. The base member alone could then be used for subsequent embedding steps. This prior apparatus had the disadvantage that if the hinge portion became broken before the processing steps were finished, the cover member would not remain mated against the base member. Loss of specimens could thus result. There is thus a commercial need for a processing apparatus which initially has a cover member attached by a hinge portion to a base member but which can remain mated against the base member in a closed position even with the hinge portion broken.

SUMMARY OF THE INVENTION

In accordance with the present invention, a unitary biological specimen processing apparatus is provided comprising an open-topped, perforated receptacle member, a cooperable perforated cover member attached to said receptacle member by a frangible hinge portion, said receptacle and cover members being capable of relative movement about said hinge portion from a first position permitting placement of a specimen in said receptacle member to a second position wherein the open top of said receptacle member is closed by said cover member, and cooperable detent and abutment means on said receptacle and cover members interengageable when said receptacle and cover members are in said second position to hold said members in said second position independently of said frangible hinge portion.

DESCRIPTION OF THE INVENTION

Figure 1:
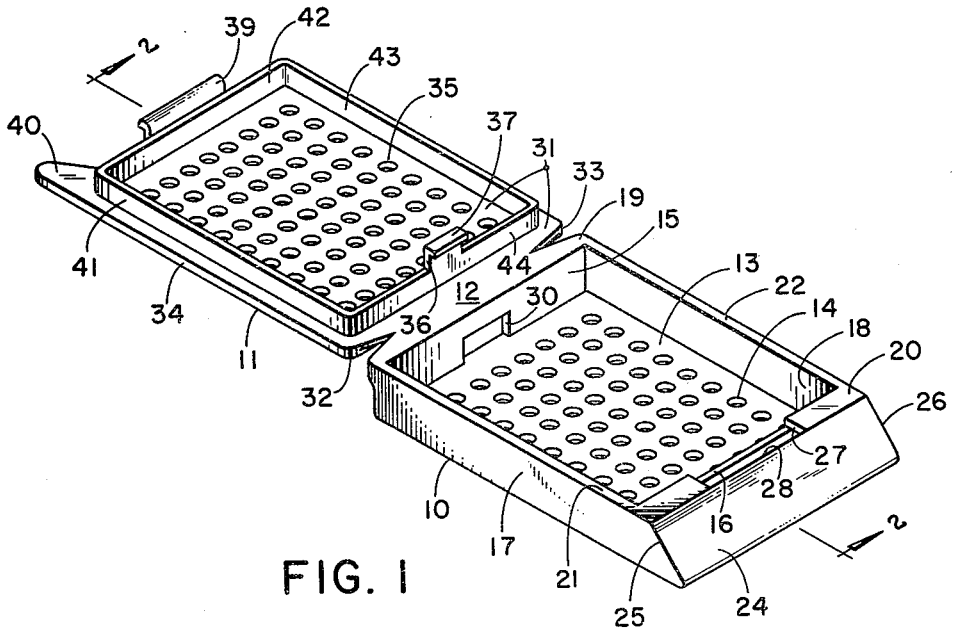
FIG. 1 is an isometric view of the apparatus of the invention in an opened or first position.
Figure 2:
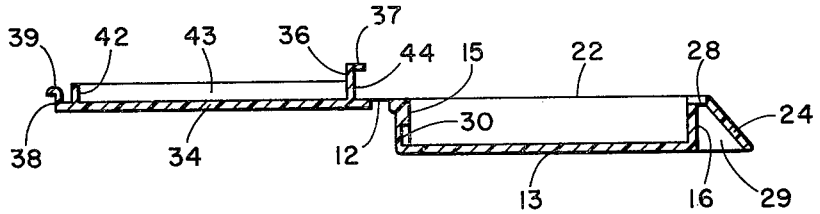
FIG. 2 is a longitudinal vertical cross-sectional view of the apparatus taken along line 2—2 of FIG. 1.

Referring to FIGS. 1 and 2, the novel apparatus of the present invention comprises a receptacle or base member 10 attached to a cover member 11 through a hinge portion 12. The open-topped box-like receptacle member 10 is formed in a generally rectangular shape with a bottom wall 13 having a plurality of perforations 14 therein, opposing parallel first and second transverse endwalls 15 and 16 and opposing parallel third and fourth longitudinal sidewalls 17 and 18 extending upward from bottom wall 13. Endwalls 15 and 16 and sidewalls 17 and 18 have coplanar upper edge surfaces 19, 20, 21 and 22, respectively, which are normal to said endwalls and sidewalls and which form a substantially flat annular top surface for receptacle member 10.

An indentation 30 is formed in first transverse endwall 15. This indentation is conveniently rectangular in shape and forms a first abutment means. Connected to and extending downwardly and outwardly from the upper edge portion 20 of the second transverse endwall 16 is a slanted wall 24, and the adjacent end portions of the longitudinal sidewalls 17 and 18 extend outwardly beyond the transverse endwall 16 to join the slanted wall 24 along slant edges 25 and 26, respectively. The upper edge portion 20 of the transverse endwall 16 is cut away as at 27 to form a transverse slot 28 which affords access to the transverse chamber 29 of generally triangular cross-section which is formed between the outer face of the transverse endwall 16 and the underside of the slanted wall 24. The portion of the slanted wall 24 at the margin of slot 28 forms a second abutment means.

The cover member 11 is formed as a flat plate 34 having an upper surface 31 which is coplanar with upper edge surface 19 of receptacle member transverse endwall 15. Notches 32 and 33 extending transversely inwardly from the outer edges of hinge portion 12 aid in rendering said hinge portion frangible. Cover member 11 preferably has a rectangular, box-like minor extension formed of walls 41, 42, 43 and 44 projecting upwardly from plate 34. The external transverse and longitudinal dimensions of this minor extension are slightly less than the corresponding internal dimensions of the open top of receptacle member 10. Flat plate 34 is formed with a plurality of perforations 35 within the walls 41 to 44. A first detent member is formed on the upper end of wall 44 in alignment with the indentation 30 on receptacle endwall 15 and comprises a portion 36 which is an extension of wall 44 and a horizontal tab 37. Tab 37 has a transverse dimension slightly smaller than the corresponding dimension of indentation 30. The cover member 11 is provided with a second detent member at the outer end edge portion of plate 34 and in alignment with the base member slot 28, said detent member being formed of a vertically extending portion 38 parallel with wall 42 and an outwardly projecting horizontal tab portion 39. Tab 39 has a transverse dimension slightly smaller than the corresponding dimension of slot 28. The detent members are of generally L-shaped cross-section projecting upwardly from plate 34 and thence horizontally in opposite longitudinal directions as shown. A lifting tab 40 is formed on the outer end of plate 34 and is coplanar therewith.

Base member 10 and cover member 11 are conveniently molded as a unitary combination structure from organoplastics, such as polyethylene, polypropylene, polystyrene, styrene-acrylonitrile copolymers, polycarbonate, formaldehyde homopolymers, copolymers of formaldehyde and trioxane, polyethylene terephthalate, polybutylene terephthalate and the like. This structure is preferably formed from formaldehyde homopolymers, copolymers of formaldehyde and trioxane, polyethylene terephthalate or polybutylene terephthalate.

Figure 3:
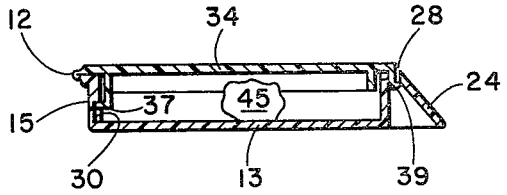
FIG. 3 is a cross-sectional view similar to that of FIG. 2 and showing the apparatus of the invention in a closed or second position.

In order to utilize the apparatus of this invention, a biological specimen, such as specimen 45 shown in FIG. 3, is placed within the receptacle member 10 when the cover and receptacle members are in the first position shown in FIGS. 1 and 2. The cover member 11 is then rotated about the hinge portion 12 to a second position to mate against the base member 10 as shown in FIG. 3. In so doing the tab 37 of the first detent member interengages indentation 30 of transverse endwall 15 and the tab 39 of the second detent member is inserted through the transverse slot 28 and interengages the underside of the slanted wall 24. Frangible hinge portion 12 is intended to break either upon mating the cover member against the base member or upon subsequently removing the cover member from the base member. If the hinge portion breaks during the above mating operation, the interengagement of the above-described detent members and abutment members will prevent undesirable separation of the cover and base members during subsequent processing steps. At the conclusion of the processing steps for the biological specimen, the cover member is conveniently removed by applying upward digital pressure on tab 40 of the cover member while applying downward digital pressure on the slanted wall 24 of the base member 10.

In the preferred form of the apparatus, the minor extension formed by walls 41, 42, 43 and 44 telescopically fits within the base member 10 as shown in FIG. 3 when the cover member is mated against said base member. This relationship prevents any undesirable space from appearing between the cover and base members as a result of warping or distortion of the cover member during subsequent processing. This also prevents any undesirable loss of specimens during processing.

In a laboratory handling a large number of specimens, it is necessary that proper specimen identification be maintained. Slanted wall 24 of member 10 is employed for this purpose. When base member 10 is formed of the above preferred material, it can be easily written upon with pencil or pen for the application of an identification designation to the slanted wall 24.

What is claimed is:

1. A unitary biological specimen processing apparatus comprising an open-topped perforated receptacle member, a cooperable perforated cover member attached to said receptacle member by a frangible hinge portion, said receptacle and cover members being capable of relative movement about said hinge portion from a first position permitting placement of a specimen in said receptacle member to a second position wherein the open top of said receptacle member is closed by said cover member, and cooperable detent and abutment means on said receptacle and cover members interengageable when said receptacle and cover members are in said second position to hold said members in said second position independently of said frangible hinge portion.

2. Apparatus according to claim 1 wherein said cover member has two detent means and said receptacle member has two cooperable abutments means.

3. Apparatus according to claim 2 wherein the detent means of said cover member are of generally L-shaped cross-section projecting upwardly and thence horizontally in opposite longitudinal directions.

4. Apparatus according to claim 2 wherein the abutment means of said receptacle member comprise an indentation in a wall of said receptacle member and a slot associated with another wall of the receptacle member.

5. Apparatus according to claim 1 wherein said frangible hinge portion is capable of being broken upon mating said cover member against said receptacle member or upon removing said cover member from said receptacle member.

6. A unitary biological specimen processing apparatus comprising an open-topped, rectangular box-like receptacle member having a perforated bottom wall, first and second opposing transverse endwalls, third and fourth opposing longitudinal sidewalls, said first transverse endwall having an indentation therein, a slanted wall with an exterior surface capable of being easily written upon extending downwardly and outwardly from the upper surface of said second transverse endwall, said third and fourth longitudinal sidewalls extending beyond said second transverse endwall to join said slanted wall to form a transverse chamber between said second transverse endwall, said slanted wall and said extensions of said third and fourth longitudinal sidewalls, said receptacle member also having a transverse slot located along the junction between said slanted wall and the upper surface of said second transverse endwall, said transverse slot providing upper access to said transverse chamber, and a removable cover member formed of a perforated rectangular flat plate having an extending tab coplanar with said flat plate and also having first and second detent members of generally L-shaped cross-section projecting upwardly and thence horizontally in opposite longitudinal directions from said cover member, said cover member being attached to said receptacle member through a frangible hinge portion such that when the cover member is rotated about said hinge portion to mate against the receptacle member, said first detent member of said cover member becomes interengageable with said indentation in said first transverse endwall of said receptacle member and said second detent member of said cover member is inserted through said transverse slot of said receptacle member and becomes interengageable with said slanted wall of said receptacle member so as to hold said cover member in removable mating relationship to said receptacle member.

7. Apparatus according to claim 6 wherein said frangible hinge portion is capable of being broken upon mating said cover member against said receptacle member or upon removing said cover member from said receptacle member.

8. Apparatus according to claim 6 wherein said cover member has a rectangular, box-like minor extension formed on said flat plate, said extension being capable of telescopically fitting within said box-like receptacle member when said cover member is mated against said receptacle member.

* * * * *